US005301835A

United States Patent [19]

Fulks et al.

[11] Patent Number: 5,301,835

[45] Date of Patent: Apr. 12, 1994

[54] ADAPTER FOR DISPENSING MATERIAL FROM A SAUSAGE TYPE PACKAGE

[75] Inventors: Henry J. Fulks, Midland; Ronald R. Kubiak, Saginaw; Timothy W. Mitin, Midland; Ronald W. Wieck, Bay City, all of Mich.

[73] Assignee: Dow Corning Corporation, Midland, Mich.

[21] Appl. No.: 946,201

[22] Filed: Sep. 17, 1992

[51] Int. Cl.[5] ..... B65D 35/14

[52] U.S. Cl. ..... 222/95; 222/105; 222/327

[58] Field of Search ..... 222/1, 95, 105, 326, 222/327, 386.5, 391

[56] References Cited

U.S. PATENT DOCUMENTS

| | | | |
|---|---|---|---|
| 2,063,410 | 12/1936 | Tear | 222/327 |
| 3,066,836 | 12/1962 | Trumbull | 222/327 |
| 4,840,293 | 7/1989 | Segatz | 222/94 |
| 4,854,485 | 8/1989 | Collins | 222/327 X |
| 4,949,875 | 8/1990 | Kuo | 222/327 X |
| 4,986,444 | 1/1991 | Covso | 222/23 |
| 5,161,715 | 11/1992 | Giannuzzi | 222/145 |

FOREIGN PATENT DOCUMENTS

| | | | |
|---|---|---|---|
| 930316 | 1/1948 | France . | |
| 1127069 | 12/1956 | France . | |
| 2237468 | 2/1975 | France | 222/326 |
| 0669165 | 2/1989 | Switzerland | 222/95 |
| 2088998 | 6/1982 | United Kingdom | 222/95 |
| 2090336 | 7/1982 | United Kingdom | 222/95 |

*Primary Examiner*—Andres Kashnikow
*Assistant Examiner*—Kenneth Bomberg
*Attorney, Agent, or Firm*—Roger H. Borrousch

[57] ABSTRACT

An adapter for use in an extrusion device can use sausage skin packaged sealant-type extrudable materials. A sausage skin package is inserted into the adapter which is, in turn, inserted into an extrusion device, such as a caulking gun. The adapter has four pieces, a cylindrical tube, a plunger, a removable nozzle base, and a removable nozzle tip. The adapter can be designed to be reversible where a sausage is inserted between the plunger and the nozzle base, force is applied to the plunger by the extrusion device forcing the sealant-type material from the sausage package and after the material is expelled, a wad of package skin is removed, a new sausage package is inserted into the open end of the tube and the removable nozzle base is attached to the tube and the dispensing operation can be continued.

13 Claims, 3 Drawing Sheets

FIG. 1
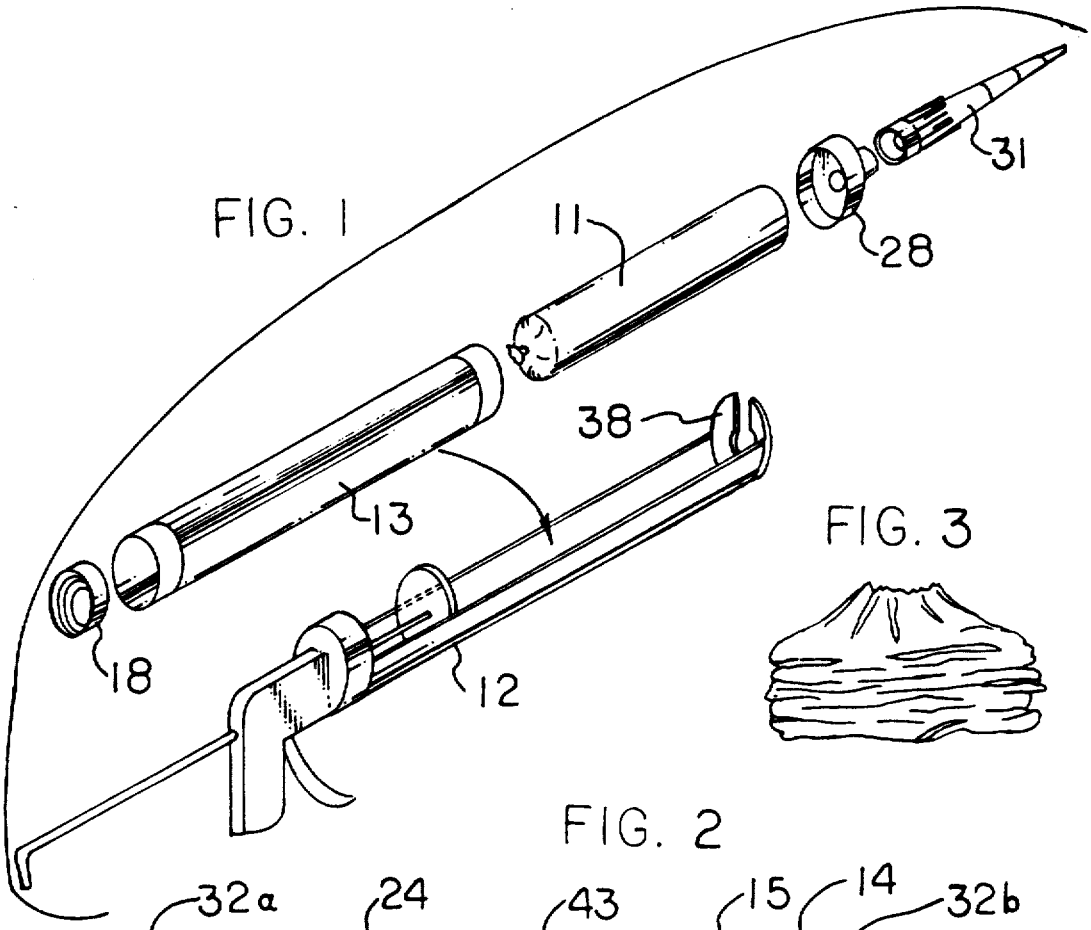
FIG. 3
FIG. 2
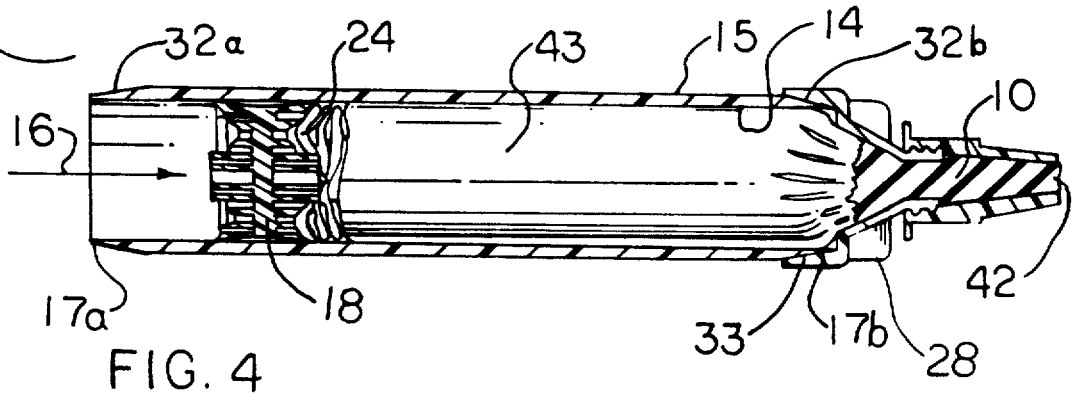
FIG. 4
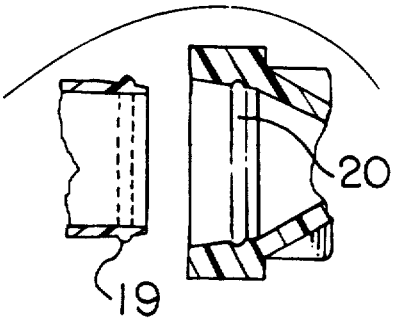

FIG. 5
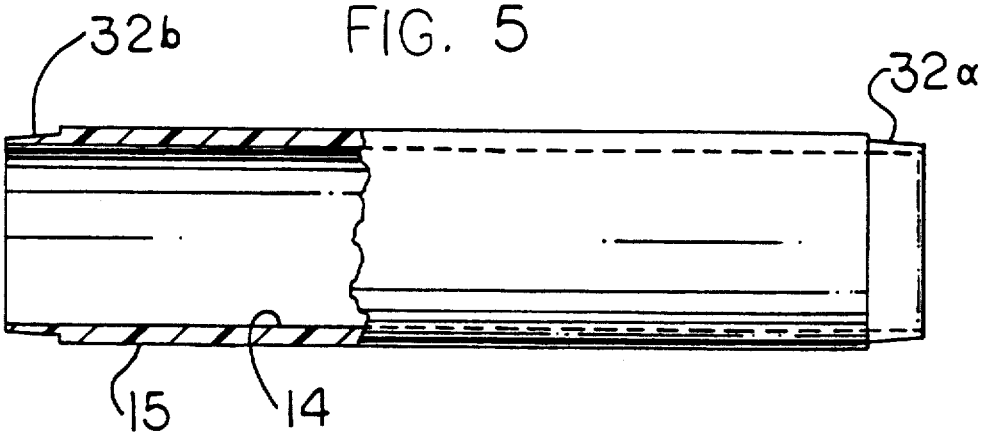
FIG. 6
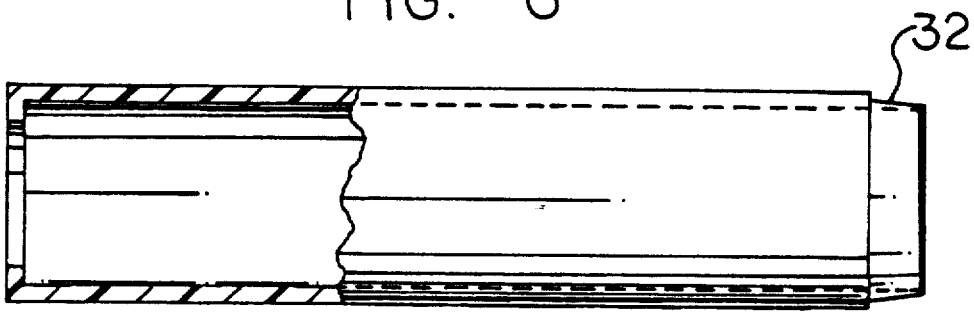
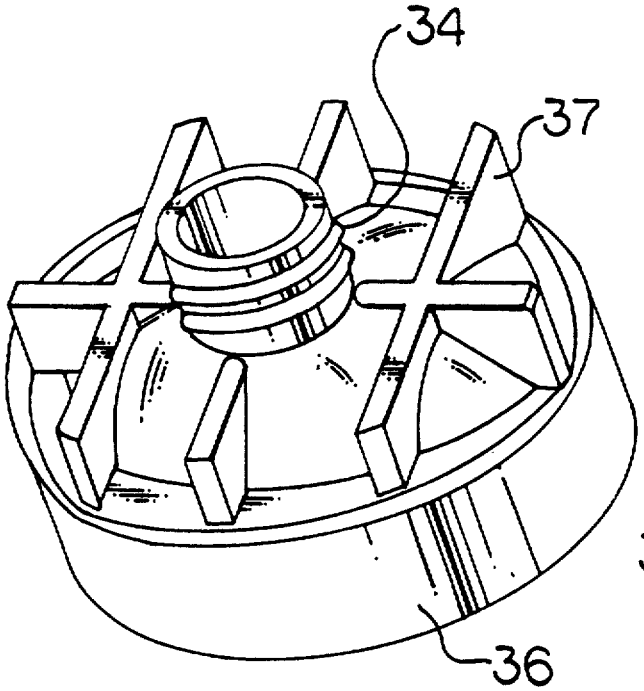
FIG. 7
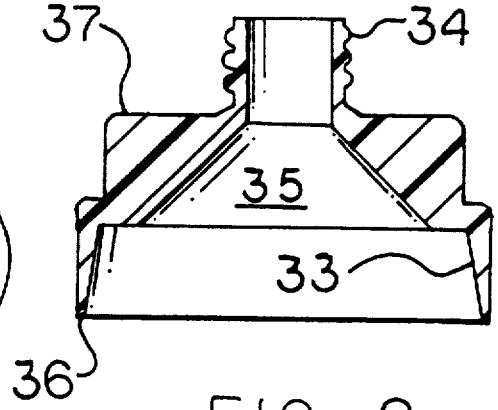
FIG. 8

ADAPTER FOR DISPENSING MATERIAL FROM A SAUSAGE TYPE PACKAGE

BACKGROUND OF THE INVENTION

1. Field of the Invention

This invention relates to a device for dispensing sealant.

2. Background Information

The use of sealing materials to fill voids in various kinds of constructions is widely known, especially in building construction. These sealing materials, also known as sealants, are used to keep undesirable environments in there proper place, such as rain, wind, or heat on the outside of buildings. These sealants are applied in a variety of forms and from a variety of apparatuses. The apparatuses used by large building construction companies or users of sealants, such as in the manufacture of appliances or automobiles, to dispense sealant materials into voids, may be very sophisticated and expensive. For many applicators of sealants, the use of a simple caulking gun to dispense sealants is the method of choice. As the use of sealants increased, the packaging for these materials changed and over several years, cartridges were the primary way to package sealant. The cartridges were most often designed with a nozzle through which a sealant composition could be extruded into a void or location requiring sealing. These cartridges were adapted to be loaded into devices equipped with mechanisms to push the sealant composition out of the cartridge package. Such devices are commonly called caulking guns or dispensing guns. These cartridges, depending on the kind of storage required for the sealant composition, were made from paper, foiled lined paper, plastic, and various kinds of molded and laminated constructions. A conventional sealant cartridge for sealants which cure by exposure to moisture, thus requiring protection from moisture during storage, is a single integrally molded cylindrical body having a nozzle which is used as an exit orifice and a plunger is disposed within the cylindrical body. Sealant composition is contained in a cavity defined by the face of the plunger in the discharge direction and the inner wall of the molded cartridge. The sealant composition is discharged through the exit orifice upon application of a force to the plunger by an extrusion device employing mechanical or pneumatic means. After as much of the sealant composition as possible is discharged from cartridge, it is discarded. These cartridges are discarded in landfills which is environmentally undesirable because the volume of the cartridge is large. To reduce the amount of waste caused by the disposal of the cartridges, the manufacturers of the sealant compositions and packages developed so called "sausage packages" for the sealant compositions. These sausage packages use much less material for the package, produce low amounts of solid waste, and can be made air and moisture impermeable, so that they can contain sealant composition which is sensitive to moisture. These sealant containing sausage packages can be inserted into some kinds of dispensing cartridges or caulking gun barrels which permits discharge of sealant composition. The waste created by the spent sausage skin is considerably lower than that created by the discard of the cartridges. However, although the amount of package waste may be reduced, the dispensing devices need to be cleaned each time a different color sealant is used or before it is set aside until required for the next use, such as overnight.

Sealant dispensers which are adapted for use with the sausage package comprise a gun barrel with a nozzle assembly forming an integral part of the barrel, or releasably attached to the barrel with suitable securing means, a piston disposed within the barrel and mechanical or pneumatic means for actuating the piston located at the opposite end of the barrel which is operated using a trigger mechanism.

Salmon in French Patent No. 930,316, granted Aug. 4, 1947 and published Jan. 22, 1948, to Expandite Products, Limited teaches a process and device for applying a composition in a seam or in a fissure. A caulking compound is hermetically sealed in a cylindrical section of a package. The material for the package is preferably a transparent sheet of cellulose acetate. One end of the package is cut by scissors so as to allow the caulking compound to be forced by a plunger of a caulking pistol through an orifice. The end of the package may be cut either before or after introducing the package charge into the pistol barrel. After forcing the charge of the pistol through the open end of the package while at the same time leaving the package in the barrel, the packaging is removed from the barrel by removing a cap and destroying it and introducing a new charge. The pistol nozzle is attached to a cap concave on the inside which covers the end of the barrel and the end of the pistol plunger is convex so as to have a surface complimentary to the concave surface of the cap so as to assure integral expulsion of the packaging composition. The device described by Salmon would be difficult to change kinds of sealants without substantial effort to clean the pistol barrel and nozzle when different kinds of sealant composition are used sequentially.

Seng in French Patent No. 1,127,069, granted on Aug. 6, 1956, and published on Dec. 7, 1956, teaches a distributor for viscous products such as greases and plastic products which can be polymerized cold before their polymerization. The distributor includes a cylindrical body sealed by a threaded cover and by a threaded piece to which the distribution adjustment is attached. Inside a body, a piston is mounted which is one piece with a rod equipped with a handle and this piston moves in this body under the effect of a spring. The piston can be kept in place when it encounters the effect of a spring by means of a jam lever which may penetrate into a cover through an opening which acts on the point of articulation and which is equipped with a drilled hole through which the rod passes with a lever being jammed obliquely onto this rod by means of the spring. The piston rod has an extension which projects from the outer side of the piston and against which a collar equipped with bosses can be kept by means of a screw. A sealing piece is also equipped with an external cylindrical throat which causes there to be a cylindrical recess with the internal wall of the body. A sack containing viscous product is placed into a cavity of the distributor and jerking movement is supplied by means of the jamming device which acts against the piston rod and which releases this rod under the effect of the operator's hand. The viscous material is contained in a casing in the form of a sack placed into the distributor body after removing the distribution adjustment and which is open after this installation. The piston is then one piece with a prominent collar equipped with vents which communicate with the back of the piston by means of holes made in this latter and which rests on the bottom of this casing. This distributor is a complicated device and not suitable for multiple kinds of product without extensive clean up.

A sealant dispensing cartridge on the market which employs sealant sausage packages comprises a self supporting cylindrical sleeve, an end cap and a plunger disposed within the sleeve, the plunger, inner wall of the sleeve and the end cap provide a cavity for the sealant sausage package. The sleeve is adapted at one end to releasably receive the end cap. The main body of the plunger comprises a cylindrical surface in sliding contact with the inner wall of the sleeve and faces, one of which is substantially flat against which force is brought to bear from a gun mechanism, the other face, in the discharge direction provides attachment means for fixing thereto a pressure relief spring which comprises a disc with diametrically opposed tongues, slightly larger in diameter than the main body of the plunger and is in frictional engagement with the inner wall of the sleeve. A plurality of holes run through the main body of plunger and the pressure release disc thus creating a pressure equalizing effect as the plunger is driven along the sleeve.

Extrusion devices employing such a cartridge generally comprise a framework in which the cartridge is supported and means for supplying a force to the plunger such as a piston which is actuated by mechanical means using a trigger mechanism, for example a skeleton gun.

Segatz in U.S. Pat. No. 4,840,293, issued Jun. 20, 1989, assigned to ARA-Werk Kramer GmbH & Co. describes an apparatus for discharging a bead or strand of pasty material from a deformable tubular container such as a tubular bag having a bag-loadable cylinder with a front face pointing in a discharge direction, the front face having a central opening aligned with a nozzle connection of the tubular bag. A substantially piston-like pressure member is axially displaceable against the tubular bag in the cylinder. In order to avoid drooling and dribbling of material through the nozzle after interruption of the discharge process and also to prevent jamming of the edges of the tubular bag, the pressure member has a pressure relief spring supported on the wall of the cylinder and cooperating therewith, the spring having spring tongues directed obliquely forward around the deformable bag. The apparatus is used to extrude sealant material encapsulated in a sausage package and comprises the cylinder adapted to receive the sausage package and a plunger which is provided with a pressure release spring attached to one face. The specification states that where pneumatic means are provided for moving the plunger, an elastic closure having a diameter slightly larger than the diameter of the main body of the plunger should be provided to seal the plunger against the inner surface of the cylinder. The elastic closure is attached to a face of the plunger opposing the face connecting the pressure release spring. While this apparatus is satisfactory in many respects, it is unsuitable for use in both mechanically operated and pneumatic extrusion devices without necessary modification of the plunger. Such modification requires the dismantling and reassembly of the apparatus, a time consuming process which is an inconvenience to an operator.

SUMMARY OF THE INVENTION

It is an object of this invention to provide an adapter which can dispense sealant composition from a sausage package, reduces cartridge and sealant waste, is easy to clean-up, is environmentally acceptable, is easy to use, and is economical. It is also a further object that the adapter be suitable for use in mechanical and pneumatic dispensing apparatuses and requires no adaptation when changing from a mechanical to a pneumatic dispensing apparatus.

This invention relates to an adapter for dispensing extrudable material contained in collapsible, flexible, cylindrical sausage-shaped skin package from an extrusion device designed for dispensing such material from a rigid cylindrical tube, said adapter comprising a rigid walled cylindrical tube having an inner wall diameter approximating the diameter of the skin package and an axial length sufficient to accommodate the length of the skin package and at least a portion of the axial length of a circular dispensing plunger, said dispensing plunger having an outer circumferential wall and first and second ends, the outer circumference of at least the first of said ends having a diameter approximating the inner wall diameter of the cylindrical tube for sliding, scraping contact therewith, the circumferential wall of the plunger intermediate to its ends having a diameter less than the diameter of said one end to reduce friction as the plunger is moved axially, said first plunger end also having a circular recess located between its movement axis and its periphery for collecting the sausage skin as material is dispensed therefrom by movement of the plunger and having an axially extending crown portion protruding beyond the plane encompassing the end of the outer wall of the plunger; the second end of the plunger shaped to allow application of force to cause said plunger to slide through the cylindrical tube.

This invention also relates to a method of dispensing an extrudable material from a container comprising applying a force to one end of a dispensing means and forcing the extrudable material from an orifice to a desired location, wherein the improvement comprises inserting a sausage package of an extrudable material into an adapter as described above between the adapter plunger and the removable nozzle base and thereafter applying a force to the adapter plunger.

BRIEF DESCRIPTION OF THE DRAWING

Description of the Figures

FIG. 1 is an exploded isometric view of a sausage-shaped skin package in an adapter in a dispensing gun.

FIG. 2 is a partial cross-section view of the adapter containing a sausage-skin package showing extrudable material being dispensed from the nozzle tip orifice and the package skin collasping as the dispensing plunger is moved toward the nozzle base.

FIG. 3 is a crumpled wad of protective skin from the sausage-shaped skin package after extrudable material has been dispensed.

FIG. 4 is an exploded view of cutaway cross section showing a locking means for the cylindrical tube and removable nozzle base.

FIG. 5 is a partial cross-section of cylindrical tube with two tapered ends.

FIG. 6 is a partial cross-section of cylindrical tube with one tapered end.

FIG. 7 is a perspective view of the removable nozzle base.

FIG. 8 is a one-half cross-section of the removable nozzle base.

Figure 9:
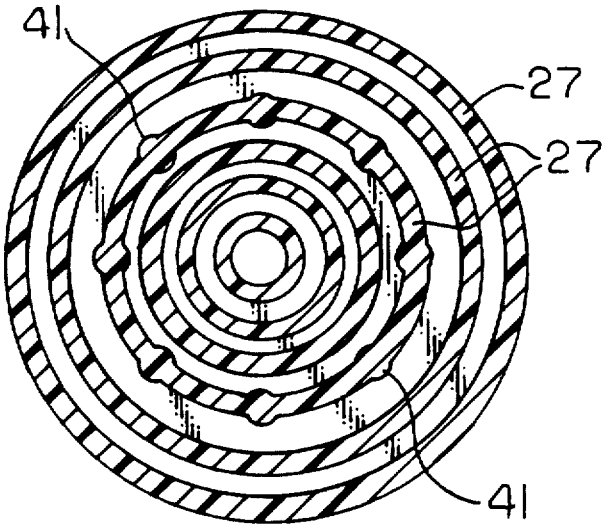

FIG. 9 is a view from the second end of the circular dispensing plunger.

Figure 10:
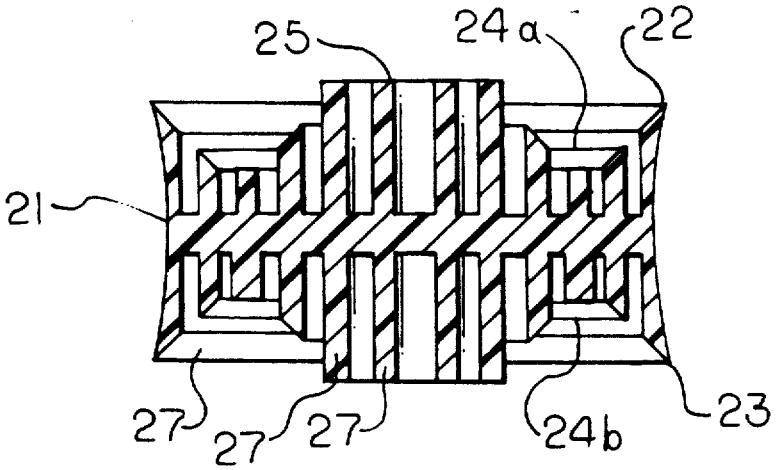

FIG. 10 is a one-half cross-section of the circular dispensing plunger.

Figure 11:
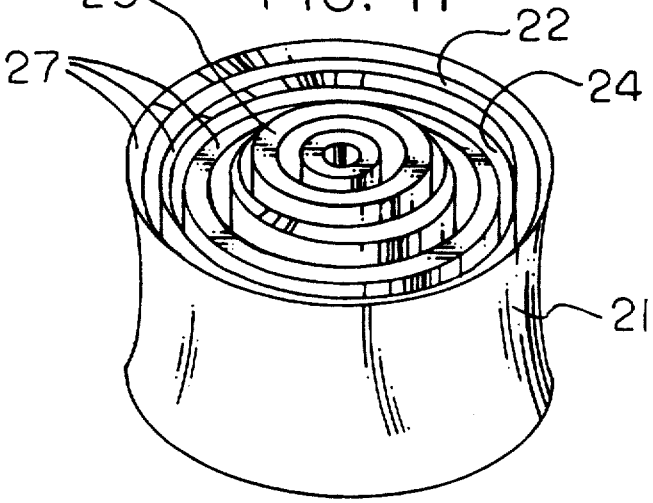

FIG. 11 is a perspective view of the circular dispensing plunger.

LIST OF REFERENCE NUMBERS AND DESCRIPTION

10—extrudable material
11—collapsible, flexible, cylindrical sausage-shaped skin package
12—extrusion device
13—rigid walled cylindrical tube
14—inner tube wall
15—outer tube wall
16—movement axis
17—tube end
18—circular dispensing plunger
19—male portion of locking means
20—female portion of locking means
21—outer circumferential plunger wall
22—first plunger end
23—second plunger end
24—circular recess
25—axially extending crown portion
27—concentric circular ribs
28—removable nozzle base
31—removable nozzle tip
32—tapered surface on tube end
33—internally tapered flange
34—threaded male portion for attachment of removable nozzle tip
35—funnel shaped portion
36—circular base of nozzle base
37—structural ribs
38—restraining plate portion
41—ejector pin pad
42—orifice
43—protective skin

DESCRIPTION OF THE PREFERRED EMBODIMENTS

Rigid walled cylindrical tube 13 of the adapter of this invention, as shown in FIGS. 1, 2, 5, and 6, can be made of any suitable durable self supporting material capable of withstanding pressures associated with the extrusion process, for example, metals such as stainless steel and aluminum or plastics such as polyvinylchloride, polypropylene, and polyethylene. It is preferred that tube 13 and the other parts of the adapter of this invention be made of plastic materials, especially recyclable plastic material such as polyethylene. The most preferred material is one which is translucent in optical properties. This translucent characteristic allows an operator of an extrusion device containing a sausage skin package to see the amount of extrudable material remaining in the sausage package as well as read at least the large print on the sausage package.

Tube 13 can be machined, molded or extruded into the correct shape and dimensions to be fitted into conventional extrusion devices, such as caulking guns as illustrated by extrusion device 12 in FIG. 1. Inner tube wall 14 and outer tube wall 15 are uniformly smooth. Tube 13 is designed to receive a collapsible, flexible, cylindrical sausage-shaped skin package 11 containing extrudable material 10. An extrusion device 12 can be used to dispense extrudable material 10. The diameter of inner tube wall 14 approximates the diameter of skin package 11 and tube 13 and has an axial length sufficient to accommodate the length of skin package 11 and at least a portion of the axial length of a circular dispensing plunger 18. The outer circumference of plunger wall 21 of plunger 18 has a first plunger end 22 and a second plunger end 23. The outer circumference of at least the first plunger end 22 has a diameter approximating the inner wall diameter of tube 13 and provides a sliding and scraping contact with the inner tube wall 14. The outer circumferential wall 21 of plunger 18 intermediate to its ends has a diameter less than the diameter of the plunger ends 22 and 23. The outer circumferential plunger wall of the plunger is illustrated by FIGS. 10 and 11. The outer circumferential plunger wall 21 has a curved concave surface in the preferred embodiment, but this surface could also have other shapes, such a "V-shape" where the point of the "V-shape" would be at a point on the outer circumferential wall of the plunger intermediate to its ends. This shape of the outer circumferential wall of the plunger is significant to permit the plunger to slide within tube 13 without binding, to act as a scraper to keep the sausage package skin and any extrudable material from getting to the side of the plunger which is opposite the compartment containing the skin package. The ends of the plunger are flexible enough to maintain a tight seal and because the shape results in a low friction between the outer circumferential plunger wall and inner tube wall 14, the plunger moves easily along the axial length of tube 13. Other shapes were tried but resulted in the skin of the sausage package binding at the interface between the outer plunger wall and the inner tube wall. This binding resulted in uneven discharge of the extrudable material or required too much pressure to extrude material from the sausage package.

Plunger 18, at least at the first plunger end, also has a circular recess 24 located between its movement axis 16 and its periphery. Circular recess 24 collects protective skin 43 of sausage skin package 11 as extrudable material 10 is dispensed from orifice 42 by movement of the plunger toward the nozzle end of the adapter along movement axis 16. The sausage skin folds in this recess and binding is avoided as the plunger is force along the tube's axial length. Plunger 18 also has an axially extending crown portion 25 protruding beyond the plane encompassing the end of the outer circumferential wall of the plunger. This crown portion mates with removable nozzle base 28 as shown in FIG. 1 and illustrated in more detail in FIGS. 7 and 8. The mating of the plunger with its crown portion and the removable nozzle base results in a very small crumpled wad of protective skin from the sausage shaped skin package after the extrudable material 10 has been dispensed. With this invention, the reduction in extrudable material wasted is substantial, compared to other delivery systems for sausage packaged which are used to discharge extrudable material, such as sealant.

The second plunger end 23 has a shape to allow the application of force which causes plunger 18 to slide through cylindrical tube 13 and dispense extrudable material 10, such as sealant compositions which cure at room temperature to an elastomeric material. However, this adapter may find use in other areas where convention dispensing equipment is used to extrude materials from a sausage package, such as in the food area, like cake frosting. The preferred adapter has both ends of the plunger essentially the same, i.e. first plunger end 22 and second plunger end 23 are essentially the same. A preferred plunger 18 is one in which the first plunger end 22, and in the most preferred embodiment, both plunger ends, comprises concentric circular ribs 27 parallel to its axis as shown in FIGS. 9, 10, and 11. The preferred plunger is made from a plastic, such as polyethylene, and is molded as a single piece. Concentric circular ribs 27 permit the plunger to be a single molded piece and formed in the shape as required for this novel adapter. The number of concentric circular ribs is not critical, but each rib needs to have a thickness and a separation between ribs sufficient to withstand pressures generated during the dispensing operation, sufficient to be molded as a single piece, and sufficient to provide the shape as shown in FIGS. 9, 10, and 11. As stated above, the most preferred plunger is one which is made from a recyclable semi-flexible material, such as plastic, is in one piece and has a curved concave surface as the outer circumferential wall, where both the first plunger end and the second plunger end are essentially mirror images of each other. In the preferred plunger which is a single molded piece with concentric structural ribs, as shown in FIGS. 9 and 10, one plunger end would contain ejector pin pads 41 which are needed to eject the molded plunger from the mold during the manufacture of the plunger. The concentric circular ribs allow the production of a plunger in one piece by a conventional molding operation. The amount of plastic material is reduced and the cost of producing and assembling two or more pieces is eliminated.

At least one end of cylindrical tube 13 is tapered toward the inner wall as shown by 32, **32*a*, and 32*b* in FIGS. 2, 5, and 6. The adapter of this invention comprises a removable circular nozzle base 28 as shown in FIG. 1 and further illustrated in FIGS. 2, 7, and 8. Nozzle base 28 has an internally tapered flange 33 which provides frictional contact with at least a portion of the tapered end, such as 32, of the outer wall of tube 13. Flange 33 and the tapered end of the outer wall 15 of tube 13 are in frictional contact when urged together. The tapered connection of tube 13 and nozzle base 28 provides a fit which keeps the nozzle base from separating from tube during the dispensing operation as force is applied to the plunger. There is a tendency for the tube and nozzle base to separate as the pusher rod of extrusion device 12 places a force on plunger 18 and nozzle base 28 is forced against restraining plate portion 38. With the tapered fit, separation is much less likely to occur. Also the tapered connection with nozzle base 28 being on the outside of tube 13, plunger 18 pushes the maximum amount of the extrudable material from the sausage package and thus the amount of waste is remarkably reduced, as shown by the crumpled wad of FIG. 3. Nozzle base 28 can contain a locking means such as a male portion of locking means 19 and female portion of locking means 20 as illustrated by FIG. 4. A locking means is not necessary, but might be used as an additional security to keep tube 13 and nozzle base 28 from separation during dispensing operations. The locking means shown in FIG. 4 is preferred because tapered flange 33 and tapered surfaces 32, 32*a*, and 32*b* are too weak at the thin portions of the tapered surfaces and would break upon repeated removal and reconnection of nozzle base 28 to tube 13**. A preferred location of a locking means, if used, is near the midpoint on the tapered surfaces.

Removable nozzle base 28 preferably has a funnel shape portion 35. This funnel shape portion permits plunger 18 to form a very small crumpled wad of protective skin as shown by FIG. 3 and at the same time allows for easy clean-up and repeated use of the adapter. Nozzle base 28 has structural ribs 37 on the outside to provide bearing surfaces for contacting restraining plate portion 38 of an extrusion device such as a dispensing gun in which the adapter is used. Structural ribs 37 form a plane perpendicular to the axial length of the adapter so that they form a flat surface against which the restraining plate portion of the extrusion device can rest during the dispensing operation. This flat surface provides for stabilization of the adapter in the extrusion device during the dispensing operation. Nozzle base 28 preferably has a threaded male portion for attachment of removable nozzle tip 31.

It is preferred that both tube ends **17*a* and 17*b* of tube 13 have outer tube wall 15 tapered toward inner tube wall 14 to provide tapered surfaces on the tube ends as shown by 32, 32*a*, and 32*b* in FIGS. 2, 5, and 6. When both tube ends are tapered, removable nozzle base 28 can be connected to either end of tube 13. This allows increased convenience and speed with which a dispensing operator can change sausage packages in the adapter and continue dispensing the extrudable material. With both ends of tube 13 tapered and plunger 18 having both plunger ends as mirror images, removable nozzle base and plunger 18 can be applied interchangeably to either end of tube 13**. The plunger would be applied to the end opposite from the end to which the removable nozzle base is applied.

A sausage skin package comprising an extrudable sealant-type material in a protective skin is inserted into cylindrical tube 13 of the adapter between adapter plunger 18 and removable nozzle base 28. Either before or after the sausage skin package is inserted into the adapter, the end of the sausage skin package at the nozzle base end is cut to allow extrudable material to be dispensed. After the sausage package is inserted into the adapter, removable nozzle base 28 is attached with removable nozzle tip 31 where an orifice 42 is formed by cutting the end of the sausage skin package, a force is applied to plunger 18 to expel the extrudable sealant-type material from sausage package 11. After the extrudable sealant-type material is expelled through removable nozzle tip 31, removable nozzle base 28 is removed and a crumpled wad of protective skin as shown by FIG. 3 is removed from the adapter. At this point, another sausage package 11 is inserted into the other end of cylindrical tube 13, without the need to reposition the plunger, and removable nozzle base 28 is attached to the open end of cylindrical tube 28. This reversibility of the adapter increases the speed with which the operator of an extrusion device can apply the extrudable material.

The four pieces of the adapter of this invention can be made of the same or different materials. For example, removable nozzle tip 31, circular dispensing plunger 18, removable nozzle base 28, and rigid walled cylindrical tube 13 can be made of the same material or different materials. It is preferred that each of these pieces be made of the same material, namely a semi-flexible material, which is recyclable with translucent optical properties. A semi-flexible material is preferred because it allows the plunger to fit into tube 13 such that plunger ends 22 and 23 are flexible enough to deform slightly when inserted into tube 13 and during the application of the force to the plunger by a push rod of an extrusion device and yet be rigid enough to maintain the circumferential wall of the plunger intermediated to the ends from creating an increase in the friction between the plunger and tube 13 such that the sliding motion of the plunger during the dispensing operation is hindered, by failure to move without excessive force, bind and release movements causing the expelled sealant bead to vary in size and shape, and even rupture of the tube itself. The plunger engages the inner wall of tube 13 providing a hermetic seal between them while keeping the frictional contact to a minimum.

Removable nozzle tip 31 is preferably a narrow cone shaped hollow piece which comes to a closed end tip opposite the female threaded end. This tip can be cut to provide different sizes of exit orifices depending on the width and/or shape of the bead of sealant-type material which is to be dispensed. Additionally, the present invention allows a nozzle tip which is removable from a nozzle base, several kinds of nozzle tips to be used with the adapter of this invention. This substantially increases the utility and versatility of the adapter of this invention. Whereas a removable nozzle tip may be discarded because of a new requirement for the size or shape of a bead of sealant composition, only the nozzle tip need be discarded and the removable nozzle base can be used again with a new nozzle tip. This reduces the amount of waste and increases the economy of the dispensing operation as well as making the adapter for the dispensing device more environmentally acceptable. The removable nozzle base can be cleaned and used again with the next sausage skin package if another kind of sealant-type material is to be used and if the same kind of sealant-type material is to be used, it does not need to be cleaned until a specific job is completed.

The adapter of this invention can be used in conventional dispensing equipment which was designed to deliver extrudable material from cartridges. Caulking gun 12 as illustrated in FIG. 1 is such a conventional dispensing apparatus for use with cartridges. The ability of the adapter of this invention to convert existing cartridge dispensing equipment to deliver extrudable material from sausage skin packages is therefore very economical.

That which is claimed is:

1. An adapter for dispensing extrudable material contained in collapsible, flexible, cylindrical sausage-shaped skin package from an extrusion device designed for dispensing such material, said adapter comprising a rigid walled cylindrical tube containing a circular dispensing plunger, said rigid walled cylindrical tube having an inner wall diameter approximating a diameter of the skin package and an axial length sufficient to accommodate a length of the skin package and at least a portion of the circular dispensing plunger, said dispensing plunger having an outer circumferential wall and first and second ends, the outer circumference of at least the first of said ends having a diameter approximating the inner wall diameter of the cylindrical tube for sliding, scraping contact therewith, the circumferential wall of the plunger intermediate to its ends having a diameter less than the diameter of said one end to reduce friction as the plunger is moved axially, said first plunger end also having a circular recess located between its movement axis and its periphery for collecting the sausage skin as material is dispensed therefrom by movement of the plunger and having an axially extending crown portion protruding beyond a plane encompassing the first end of the outer wall of the plunger; the second end of the plunger shaped to allow application of force to cause said plunger to slide through the cylindrical tube, the first and second ends of the plunger are essentially the same and have concentric circular ribs parallel to the movement axis.

2. The adapter as claimed in claim 1 in which the outer circumferential wall of the plunger has a curved concave surface between the first and second ends and the two ends are essentially mirror images of each other.

3. The adapter as claimed in claim 2 in which the plunger is made of a semi-flexible material.

4. The adapter as claimed in claim 3 in which the semi-flexible material is recyclable.

5. An adapter for dispensing extrudable material contained in a collapsible, flexible, cylindrical sausage-shaped skin package from an extrusion device designed for dispensing such material, said adapter comprising a rigid walled cylindrical tube containing a circular dispensing plunger, said rigid walled cylindrical tube having an inner wall and an outer wall and two ends where the inner wall diameter approximates a diameter of the skin package and an axial length sufficient to accommodate a length of the skin package and at least a portion of the circular dispensing plunger, both ends of the outer wall of the cylindrical tube are tapered toward the inner wall, said dispensing plunger having an outer circumferential wall and first and second ends. the outer circumference of at least the first of said ends having a diameter approximating the inner wall diameter of the cylindrical tube for sliding, scraping contact therewith, the circumferential wall of the plunger intermediate to its ends having a diameter less than the diameter of said one end to reduce friction as the plunger is moved axially, said first plunger end also having a circular recess located between its movement axis and its periphery for collecting the sausage skin as material is dispensed therefrom by movement of the plunger and having an axially extending crown portion protruding beyond a plane encompassing the first end of the outer wall of the plunger; the second end of the plunger shaped to allow application of force to cause said plunger to slide through the cylindrical tube, the first end of the plunger has concentric circular ribs parallel to the movement axis, said adapter further comprises a removable circular nozzle base with an internally tapered flange of a diameter which provides frictional contact with at least a portion of the tapered outer wall of the cylindrical tube when the tube and nozzle base are urged together, the removable nozzle base and the dispensing plunger can be applied interchangeably to either end of the cylindrical tube; the plunger being applied to the end opposite from the end to which the removable nozzle base is applied.

6. The adapter as claimed in claim 5 in which the tube and removable nozzle base have a means for locking when urged together.

7. The adapter as claimed in claim 5 in which the plunger is made of a semi-flexible material.

8. The adapter as claimed in claim 5 in which both ends of the plunger comprise concentric circular ribs parallel to the movement axis.

9. The adapter as claimed in claim 8 in which the plunger is made of semi-flexible material.

10. The adapter as claimed in claim 8 in which the nozzle base further includes a funnel shaped portion extending from a circular base of the nozzle base and a plurality of structural ribs extending from at least a portion of the funnel shaped portion in planes parallel to the movement axis of the nozzle base to provide bearing surfaces for contacting a restraining plate portion of a dispensing gun in which the adapter is to be used.

11. The adapter as claimed in claim 10 in which the outer circumferential wall of the plunger has a curved surface between its first and second ends and the two ends are essentially mirror images of one another.

12. The adapter as claimed in claim 11 in which the plunger is made of semi-flexible material.

13. The adapter as claimed in claim 12 in which the tube is at least translucent in optical properties.

* * * * *